United States Patent [19]

Dumont et al.

[11] 4,073,434

[45] Feb. 14, 1978

[54] SYSTEM FOR HEATING BUILDINGS

[75] Inventors: Maurice Dumont, St-Ismier; Gérard Marie, Eybens, both of France

[73] Assignee: Commissariat a l'Energie Atomique, Paris, France

[21] Appl. No.: 709,944

[22] Filed: July 29, 1976

[30] Foreign Application Priority Data

Aug. 5, 1975 France ..... 75 24405

[51] Int. Cl.[2] ..... G05D 23/00

[52] U.S. Cl. ..... 237/2 B; 62/238

[58] Field of Search ..... 237/9 R, 9 B, 2B, 67, 237/74; 62/238, 79, 8 B; 165/105

[56] References Cited

U.S. PATENT DOCUMENTS

| | | | |
|---|---|---|---|
| 944,183 | 12/1909 | Finley | 237/9 |
| 1,899,977 | 3/1933 | Murray et al. | 237/67 |
| 1,942,831 | 1/1934 | Perry | 237/74 |
| 2,883,591 | 4/1959 | Camp | 165/105 |
| 3,078,043 | 2/1963 | Eichmann | 165/105 |
| 3,770,196 | 11/1973 | Griffith et al. | 237/9 R |
| 3,984,050 | 10/1976 | Gustafsson | 237/2 B |

FOREIGN PATENT DOCUMENTS

| | | | |
|---|---|---|---|
| 6,714 of | 1899 | United Kingdom | 237/67 |

OTHER PUBLICATIONS

Steam & hot water heating 4-135, pp. 4-135 & 4-136, from Handbook of Air Conditioning, Heating & Ventilating, copyright 1959.

*Primary Examiner*—William E. Wayner
*Assistant Examiner*—Robert J. Charvat
*Attorney, Agent, or Firm*—Cushman, Darby & Cushman

[57] ABSTRACT

The heating system comprises at least one vertical heating duct through which is passed an upward stream of vapor and a downflowing stream of condensate, heating units placed in each of the premises to be heated and each comprising a condenser connected to a heating duct by means of a vapor withdrawal pipe and a condensate return pipe, a liquid-vapor separator for collecting the condensate at the lower end of the heating duct, an evaporator for delivering vapor to the central portion of the heating duct, at least one unit of the heat pump type for superheating the vapor of the heating duct.

2 Claims, 5 Drawing Figures

SYSTEM FOR HEATING BUILDINGS

This invention relates to a system for heating buildings.

Heating installations which make use of vapor at atmospheric pressure are already known. These installations are subject to disadvantages, especially in regard to the need for large duct diameters in premises to be heated. Furthermore, such installations do not have sufficient flexibility of use to enable each user to control the level of heating in his own premises independently of his neighbours and according to his own requirements. The present invention is accordingly directed to a system which removes these disadvantages, primarily by virtue of the fact that it is simple to put into operation and that it offers numerous possibilities of adjustment.

In more precise terms, the invention has for its object a system for heating buildings which essentially comprises:

at least one vertical heating duct through which is passed an upward stream of vapor and a downflowing stream of condensate, heating units placed in each of the premises to be heated and each comprising a condenser which is connected to one of the heating ducts at the upstream end by means of a branch pipe for drawing-off vapor and at the downstream end by means of a condensate return pipe, at the lower end of the heating duct, a liquid-vapor separator which collects the condensate and is followed by an evaporator which delivers vapor to the central portion of the heating duct, said evaporator being supplied from an external heat source, at least one unit of the heat pump type for superheating the vapor of the heating duct, said unit being associated with means for putting it into circuit in either an intermittent or a continuous manner.

In a first embodiment, the system in accordance with the invention comprises a single superheating unit for the entire system.

In a second embodiment, at least one of the heating units placed within the premises to be heated is associated with an independent superheating unit.

The return of the condensate downstream of the condenser can be fitted with an drain cock.

It is readily apparent that any combination of these two particular embodiments form part of the invention, especially the combination which consists in making use of a superheating unit placed at the lower end of the heating duct and individual superheating units associated with certain heating units.

The characteristic features and advantages of the invention will in any case become more readily apparent from the following description of exemplified embodiments which are given by way of explanation and not in any limiting sense, reference being made to the accompanying drawings, wherein.

Figure 1:
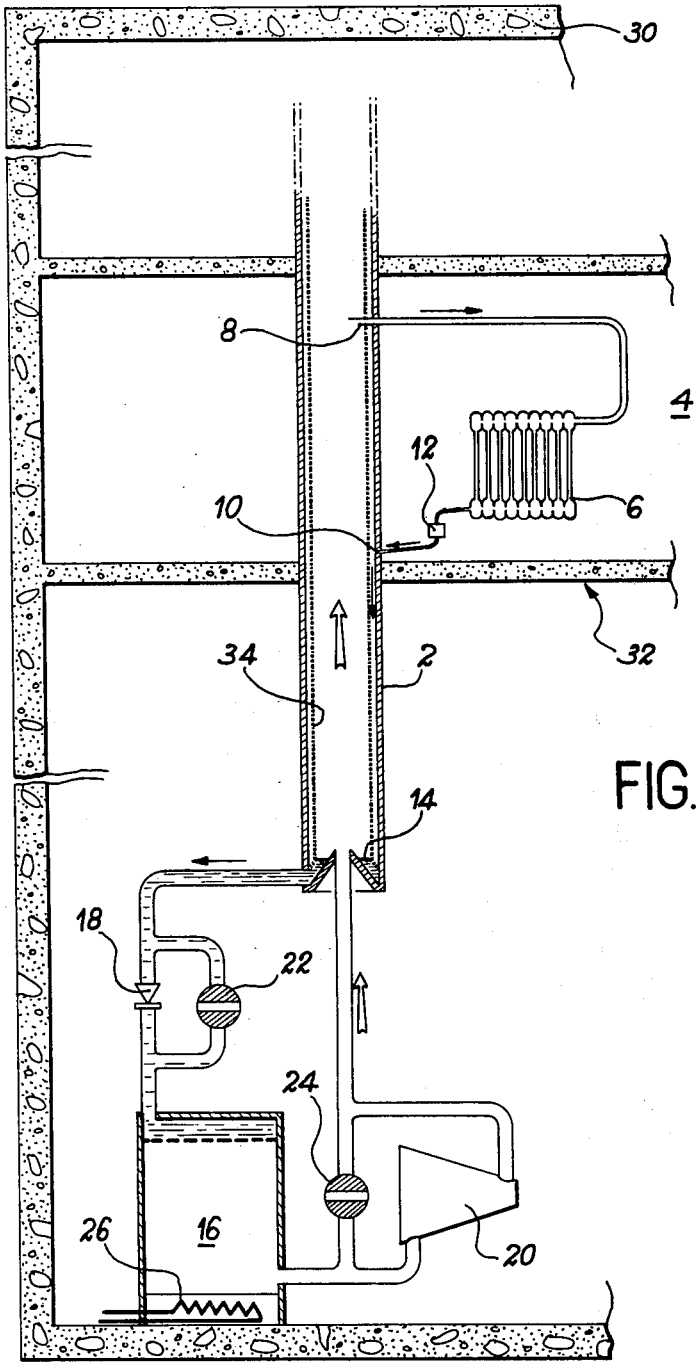
FIG. 1 illustrates the device of the invention in accordance with the first embodiment in which a single superheating unit is employed for the entire installation.

The installation shown in FIG. 1 comprises a heating duct 2, heating units placed within the premises 4 to be heated and each comprising a condenser 6 connected to the heating duct 2 by means of a branch pipe 8 and by a condensate return pipe 10 fitted with a drain cock 12; at the lower end of the heating duct 2, a liquid-vapor separator 14 followed by an evaporator 16 which can be of any known type and especially of the falling-film type. The means for supplying heat to the evaporator 16 are represented schematically by heating means 26. A unit of the heat pump type for superheating the heating duct vapor comprises an expansion valve 18 and a compressor 20, said superheating unit being associated with means for putting it into circuit, said means being represented diagrammatically in FIG. 1 by control valves 22 and 24.

The operation of the installation described above is as follows: there is circulated within the heating duct an upward flow of vapor consisting preferably of a chlorofluorohydrocarbon and a condensate which passes downwards along the walls; a grid 34 can be provided for improving the separation between the down-flow of condensate and the up-flow of vapor. When the control valves 22 and 24 are open, the condensate is vaporized within the evaporator 16 which is supplied by the separator 14. The vapor delivered by the evaporator 16 is introduced along the axis of the heating duct at the lower end of this latter. At each stage, said vapor is drawn-off via the branch pipes 8 and passes through the condensers 6; the condensate returns to the heating duct via the drain cock 12 and the return pipe 10.

The energy which is necessary for the evaporation can be supplied by any known means such as, for example, the heat-transporting fluid of a district heating supply system, a heat storage enclosure, thermal effluents of nuclear power stations or of factories, a geothermal source or an underground water-table.

When a user desires to have additional heat or when the level of heat delivered to the evaporator is too low (this can be the case if use is made of an underground water-table, for example, or at the end of a cold period when the storage of heat becomes insufficient), it is possible to raise the thermal level by means of the superheating unit constituted by the means 18 and 20. These means are put into circuit by closure of the control valves 22 and 24 and form a heat pump in conjunction with the other means described earlier.

In more precise terms, when the control valves 22 and 24 are closed (which corresponds to the case illustrated in FIG. 1), the fluid passes successively through the expansion valve 18, the evaporator 16, the compressor 20 and the condenser 6, which constitutes the known cycle of a heat pump.

It is thus apparent that the means 16 serve both as evaporator for the heating duct and as evaporator for the heat pump; the same applies to the condenser 6.

Solely by way of explanation, an installation of this type is capable of operating with a storage of energy at a temperature of approximately 50° C; at the outlet of the evaporator, the temperature of the vapor can be approximately 45° C. The control valves 22 and 24 are open under normal operating conditions and it is thus possible without any additional consumption of electric powder to heat during a between-season period or even in winter during the middle of the day if the weather permits. As soon as the temperature of the premises falls below a predetermined threshold value, the compressor 20 is started-up and the control valves 22 and 24 are closed. The temperature of the vapor can be brought to approximately 75° C in respect of an efficiency of the heat pump of approximately 7.

By means of an installation of this type, all the users who are grouped around a common heating-duct column derive benefit from the superheating unit when this latter is in service. This arrangement is conducive to the achievement of good efficiency and low cost by reason of the large size of the elements. However, it does not enable each user to decide freely on the expediency of initiating a superheating operation. If it is desired to provide each user with this possibility, it is necessary to place superheating units directly in the premises to be heated in order that they may be controlled independently of each other. The corresponding installation is accordingly designed in accordance with the arrangement shown in FIG. 2.

In this figure, the installation shown comprises a heating duct 40, a liquid-vapor separator 42, an evaporator 44 and superheating units placed within the premises to be heated. Only one of these units is shown within a building 48 and designated by the reference 46. This unit comprises a compressor 50, a condenser 52 and an expansion valve 54; the connection with the heating duct 40 is established at the upstream end by means of the branch pipe 56 and at the downstream end by means of the condensate return pipe 58. A power fan 60 which produces action on the condenser 52 completes the superheating unit.

In this embodiment, each user has a guaranteed heat supply at a minimum level; but he has the possibility of raising this level by putting into service the superheating means 46 which he has at his personal disposal while naturally bearing the cost of the electric power which is necessary for the operation of these means.

Figure 2:
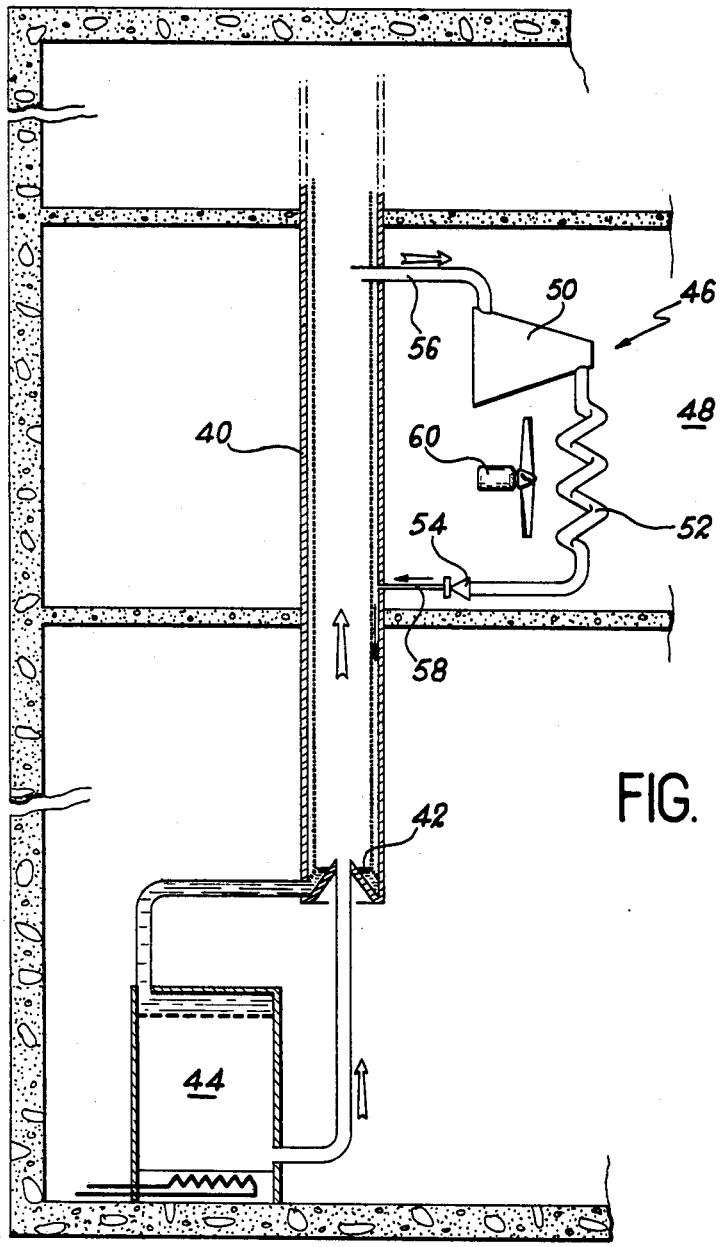
FIG. 2 illustrates the device of the invention in accordance with the second embodiment in which the superheating unit is associated with the heating units in the actual premises to be heated.

It is readily apparent that the two alternative embodiments of FIGS. 1 and 2 can be combined and that it is possible in some premises to make use both of a compressor at the lower end of the heating duct and of the superheating units.

Figure 3:
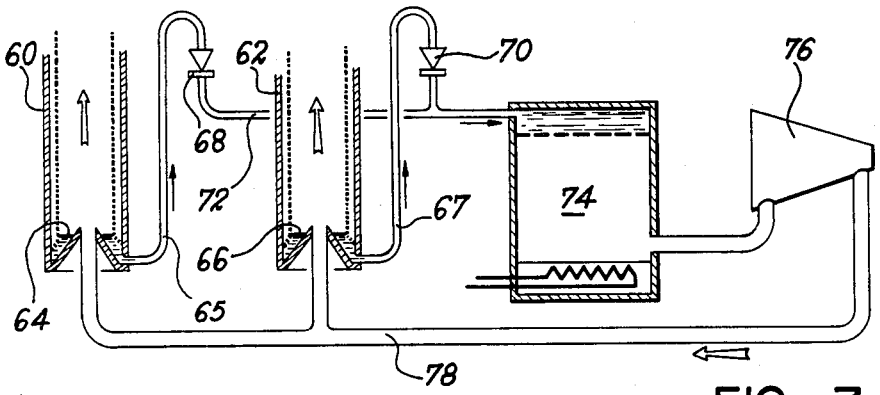
FIG. 3 illustrates an installation comprising a plurality of heating ducts arranged in parallel.

One of the advantages of the use of a compressor at the lower end of the heating duct lies in the fact that the pressure difference which it produces is sufficient to compensate for horizontal pressure drops in liquid phase downstream of the expansion valve. Accordingly, it is possible to provide an installation comprising a number of vertical heating ducts which are connected to each other at their lower ends by means of a condensate manifold of appreciable length as shown in FIG. 3.

In this figure, the heating ducts 60 and 62 are fitted with liquid-gas separators 64 and 66 connected by means of pipes 65 and 67 to expansion valves 68 and 70. A manifold 72 collects the condensates after expansion and supplies a single evaporator 74 whilst a compressor 76 delivers vapor to the heating ducts 60 and 62 via the manifold 78. The use of the compressor 76 serves to compensate for horizontal pressure drops in liquid phase downstream of the expansion valves 68 and 70.

Figure 4:
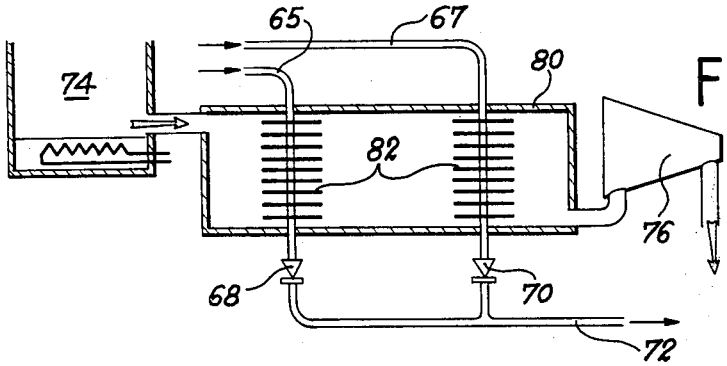
FIG. 4 illustrates an improvement in the superheating unit.

As shown in FIG. 4 and in accordance with a known improvement which is characteristic of heat pumps, a regenerator-superheater 80 can be placed on the one hand at the exit of the evaporator 74 in order to superheat the vapor prior to admission of this latter into the compressor 76 and, on the other hand, in the condensate circuit upstream of the expansion valves 68 and 70. The ducts 65 and 67 are in that case each provided with fins 82 which promote heat exchanges.

Figure 5:
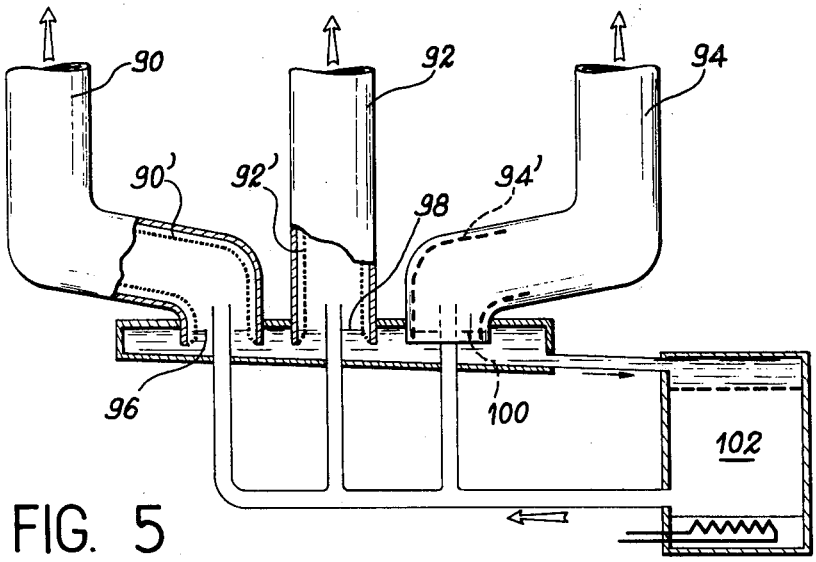
FIG. 5 illustrates an alternative form in which a plurality of heating ducts are joined at their lower ends to a single condensate manifold.

Even when no provision is made for a compressor at the lower end of the heating columns, the heating-duct effect permits re-supply of liquid to an evaporator which is located horizontally at a certain distance from the foot of the column in accordance with the arrangement shown in FIG. 5. In this figure, heating ducts 90, 92 and 94 are associated with separators 96, 98 and 100 respectively which are connected to an evaporator 102 of the falling-film type which re-supplies the heating ducts in the central portion of these latter. Grids 90', 92' and 94' respectively are placed within the heating ducts 90, 92 and 94 and serve to convey the liquid by capillarity towards the separators 96, 98 and 100.

The configurations of FIGS. 3 and 5 are particularly well adapted to district heating since they entail the need for only a single heat exchanger; this is conducive to a reduction in the cost of the installation compared with installations equipped with a number of heat-exchanger units which are distributed in the proportion of one unit per heating column.

We claim:

1. A system for heating buildings, wherein said system comprises:

at least one vertical heating duct through which is passed an upward stream of vapor and a downflowing stream of condensate, heating units placed in each of the premises to be heated and each comprising a compressor which is connected to one of the heating ducts at the upstream end by means of a branch pipe for drawing-off vapor, a condenser which is connected to said compressor and an expansion valve which is connected to said one of the heating ducts by means of a condensate return pipe, at the lower end of the heating duct, a liquid-vapor separator which collects the condensate and is followed by an evaporator which delivers vapor to the central portion of the heating duct, said evaporator being supplied from an external heat source.

2. A heating system according to claim 1, wherein the fluid employed is a chlorofluorohydrocarbon.

* * * * *